US010088276B2

(12) United States Patent
Lohan

(10) Patent No.: US 10,088,276 B2
(45) Date of Patent: Oct. 2, 2018

(54) PROGRAMMABLE ADJUSTMENT ARCHERY SIGHTING DEVICE

(71) Applicant: Jeramie John Lohan, Sioux Falls, SD (US)

(72) Inventor: Jeramie John Lohan, Sioux Falls, SD (US)

( * ) Notice: Subject to any disclaimer, the term of this patent is extended or adjusted under 35 U.S.C. 154(b) by 154 days.

(21) Appl. No.: 15/185,721

(22) Filed: Jun. 17, 2016

(65) Prior Publication Data

US 2017/0363389 A1 Dec. 21, 2017

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265; 124/87
See application file for complete search history.

(56) References Cited

U.S. PATENT DOCUMENTS 2,893,124 A * 7/1959 Sundquist ..... F41G 1/467 33/265
3,355,809 A * 12/1967 Guyton ..... F41G 1/467 33/265
3,487,548 A * 1/1970 Frydenlund ..... F41G 1/467 33/265
3,674,002 A * 7/1972 Diamond, Sr. ..... F41G 1/467 124/24.1
3,696,517 A * 10/1972 Larson ..... F41G 1/467 33/265
3,766,656 A * 10/1973 Westphal ..... F16B 5/0225 124/87
4,481,717 A * 11/1984 Kowalski ..... F41G 1/467 124/87
4,617,741 A * 10/1986 Bordeaux ..... F41G 1/473 124/87
4,823,474 A * 4/1989 Reynolds ..... F41G 1/473 124/87
5,425,177 A * 6/1995 Pacenti ..... F41G 1/467 124/87
5,495,675 A * 3/1996 Huang ..... F41G 1/35 124/87
5,524,351 A * 6/1996 Pinson ..... F41G 1/467 124/87
5,575,072 A * 11/1996 Eldridge ..... F41G 1/467 124/87
6,802,129 B1 10/2004 Wirth
(Continued)

*Primary Examiner* — Christopher Fulton

(57) ABSTRACT

A programmable adjustment archery sighting device provides motorized adjustment through a series of programmable sighting settings. The device includes a pair of spaced mounting apertures extending into an elongated mounting bracket for fixedly coupling the mounting bracket to a bow. A position of a sight coupled to the mounting bracket is adjustable. A vertical adjustment mechanism adjusts a position of the sight and includes a first vertical adjustment control. A vertical adjustment motor is coupled to the mounting bracket and operationally coupled to the vertical adjustment mechanism. A housing is configured for being positioned on the bow spaced from the mounting bracket and accessible to fingers on a hand grasping a grip of the bow. The first vertical adjustment control is positioned on the housing and operationally coupled to the vertical adjustment motor to adjust the vertical position of the sight by manipulation of the first vertical adjustment control.

13 Claims, 8 Drawing Sheets

(56) References Cited

U.S. PATENT DOCUMENTS

| | | | |
|---|---|---|---|
| 6,823,597 | B2 | 11/2004 | Larson |
| 7,392,590 | B2 | 7/2008 | Gordon |
| 8,914,984 | B2 | 12/2014 | Adams et al. |
| 9,062,935 | B2 | 6/2015 | Adams et al. |
| 9,097,491 | B2 | 8/2015 | Summers et al. |
| 9,103,631 | B2 | 8/2015 | Evans |
| 2013/0247399 | A1 | 9/2013 | Evans |

* cited by examiner

PROGRAMMABLE ADJUSTMENT ARCHERY SIGHTING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to archery sighting devices and more particularly pertains to a new archery sighting device for providing motorized adjustment through a series of programmable sighting settings.

BRIEF SUMMARY OF THE INVENTION

An embodiment of the disclosure meets the needs presented above by generally comprising a pair of spaced mounting apertures extending into an elongated mounting bracket for fixedly coupling the mounting bracket to a bow. A position of a sight coupled to the mounting bracket is adjustable. A vertical adjustment mechanism adjusts a position of the sight and includes a first vertical adjustment control. A vertical adjustment motor is coupled to the mounting bracket and operationally coupled to the vertical adjustment mechanism. A housing is configured for being positioned on the bow spaced from the mounting bracket and accessible to fingers on a hand grasping a grip of the bow. The first vertical adjustment control is positioned on the housing and operationally coupled to the vertical adjustment motor to adjust the vertical position of the sight by manipulation of the first vertical adjustment control.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
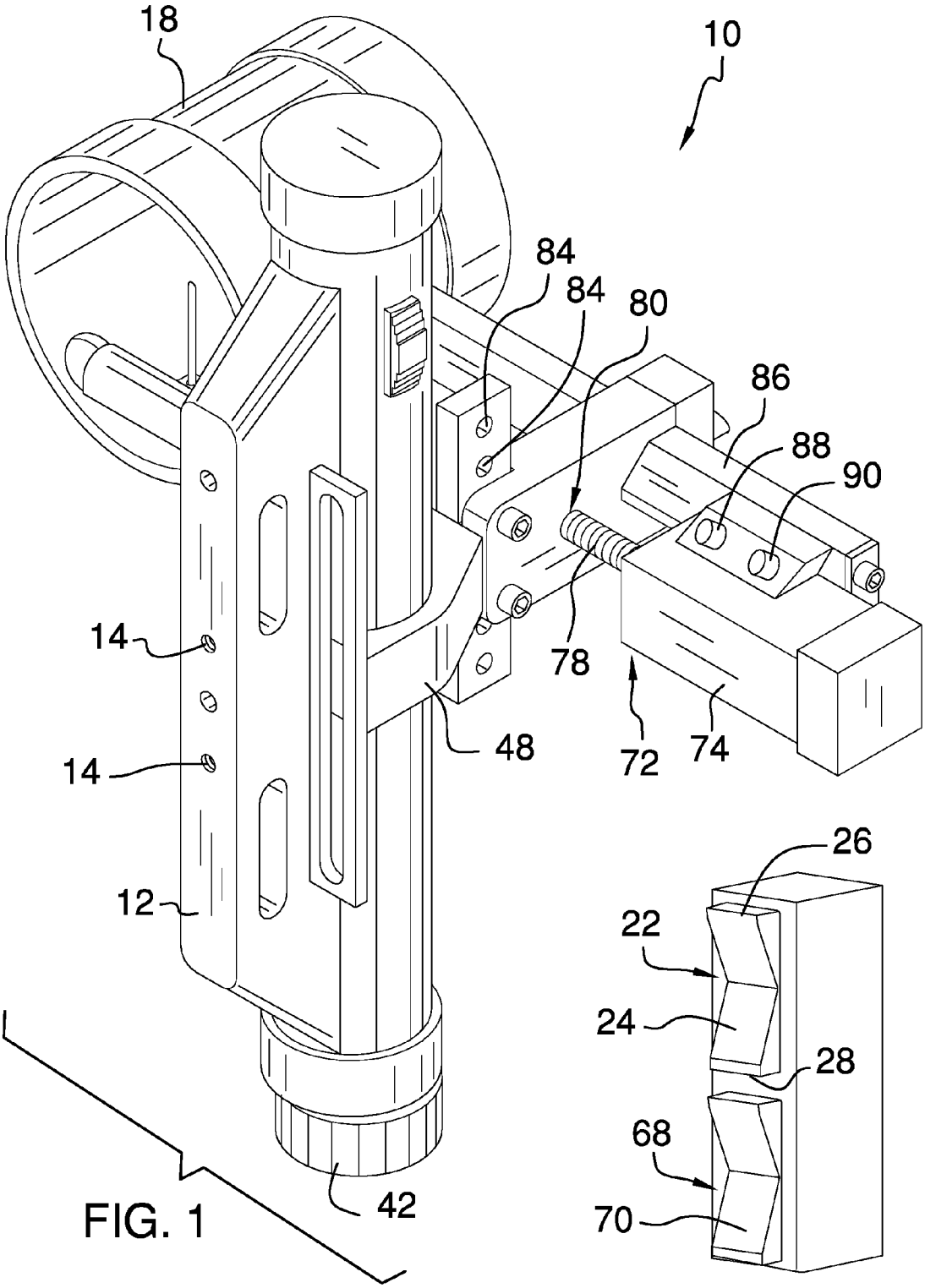
FIG. 1 is a top rear side perspective view of a programmable adjustment archery sighting device according to an embodiment of the disclosure.
Figure 2:
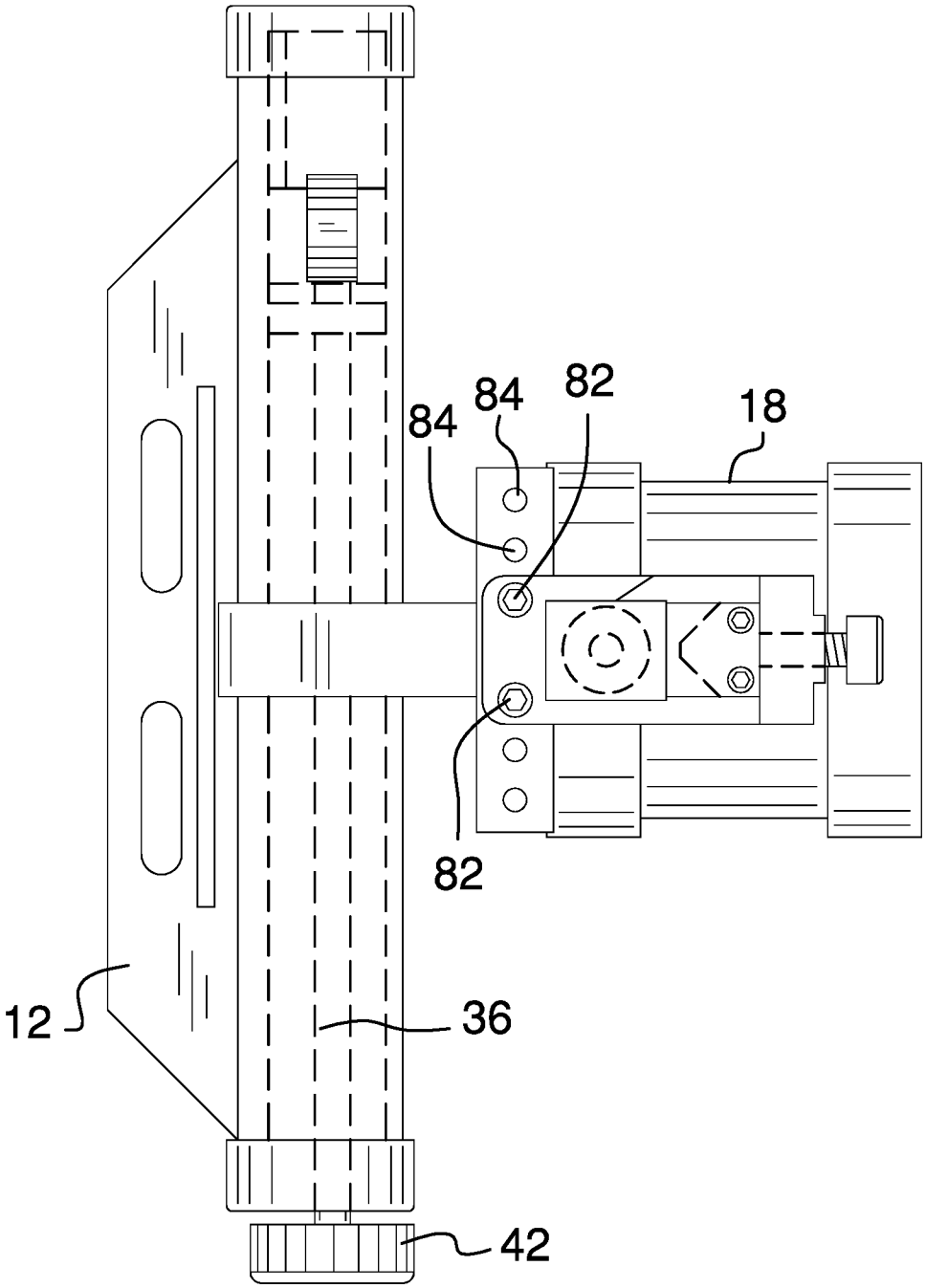
FIG. 2 is a side view of an embodiment of the disclosure.
Figure 3:
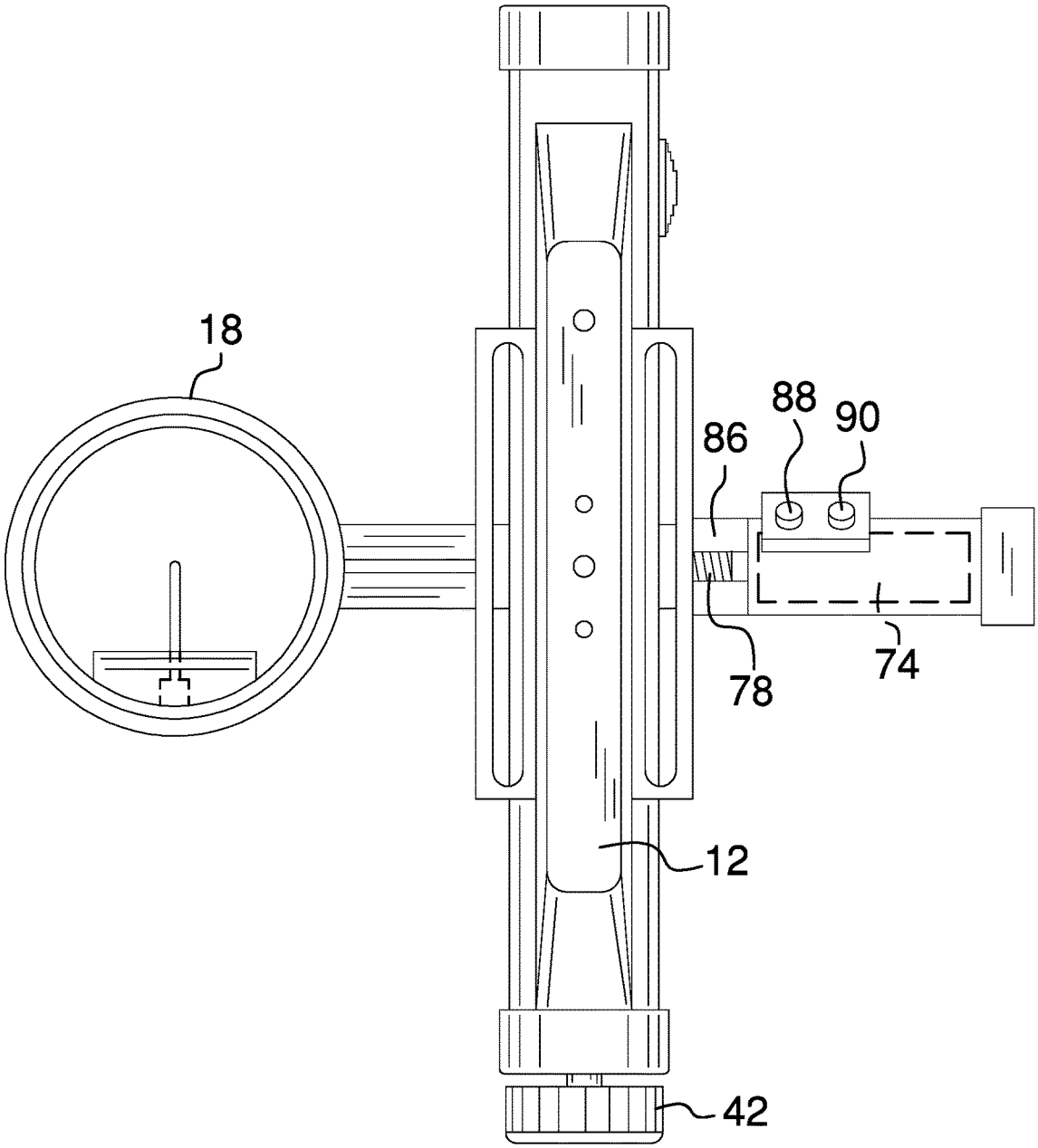
FIG. 3 is a rear view of an embodiment of the disclosure.
Figure 4:
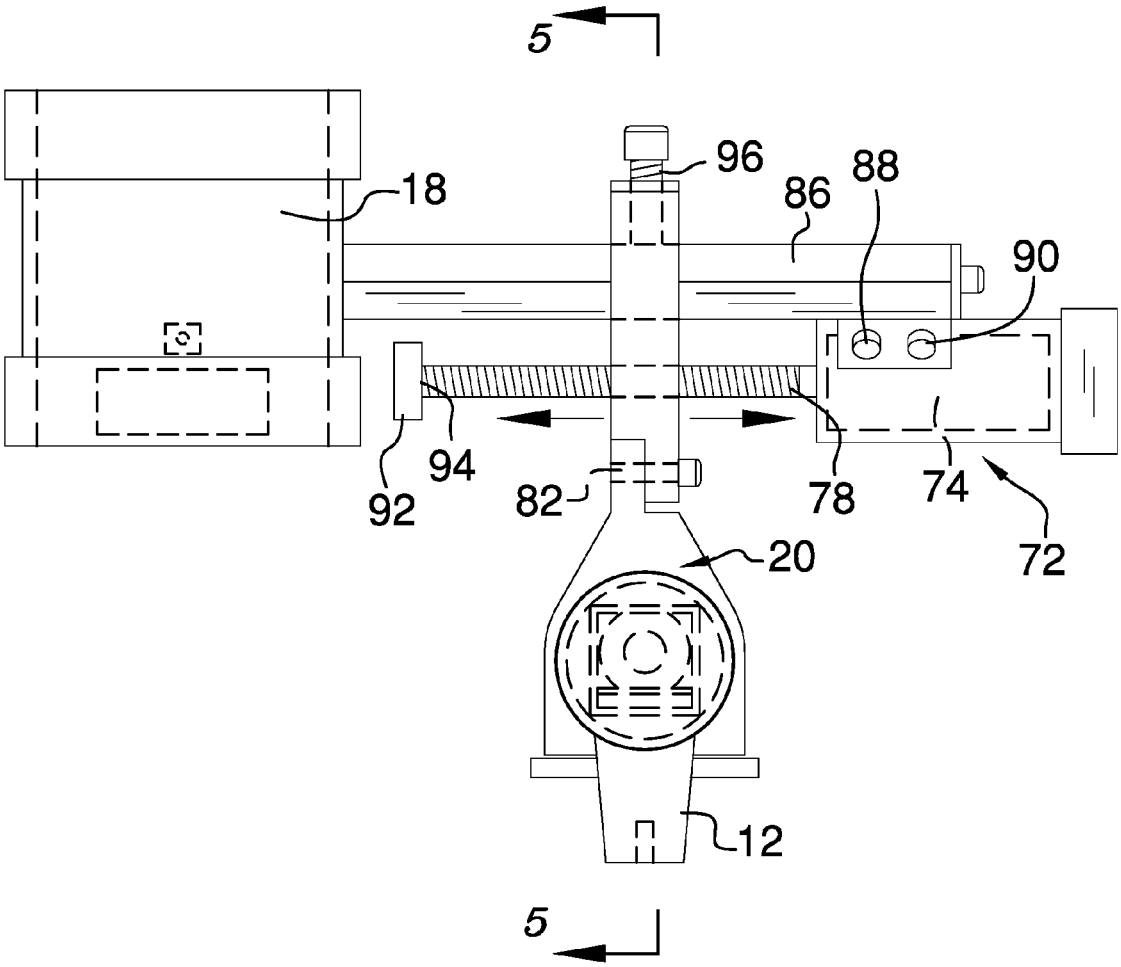
FIG. 4 is a top view of an embodiment of the disclosure.
Figure 5:
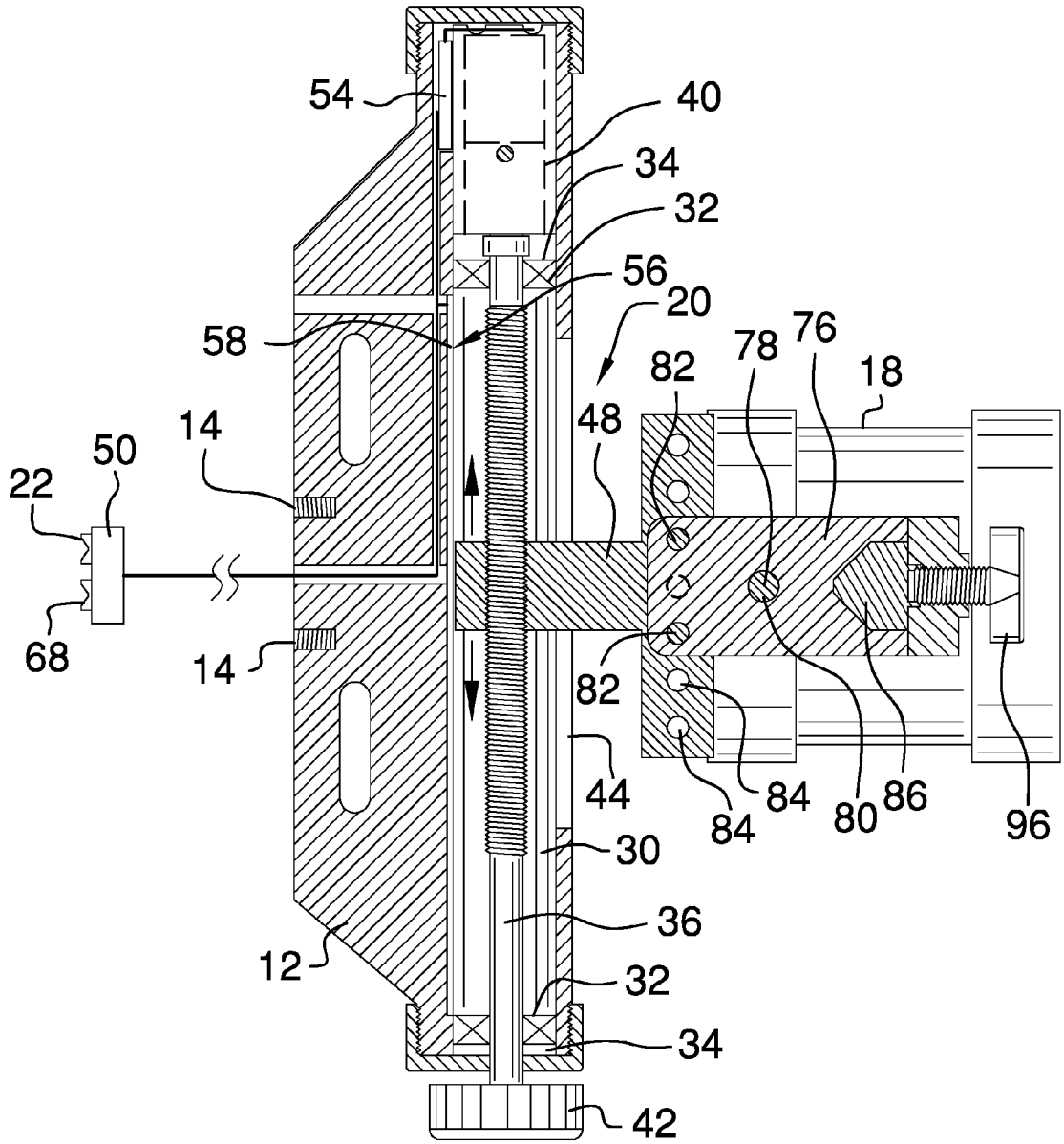
FIG. 5 is a cross-sectional view of an embodiment of the disclosure taken along line 5-5 of FIG. 4.
Figure 6:
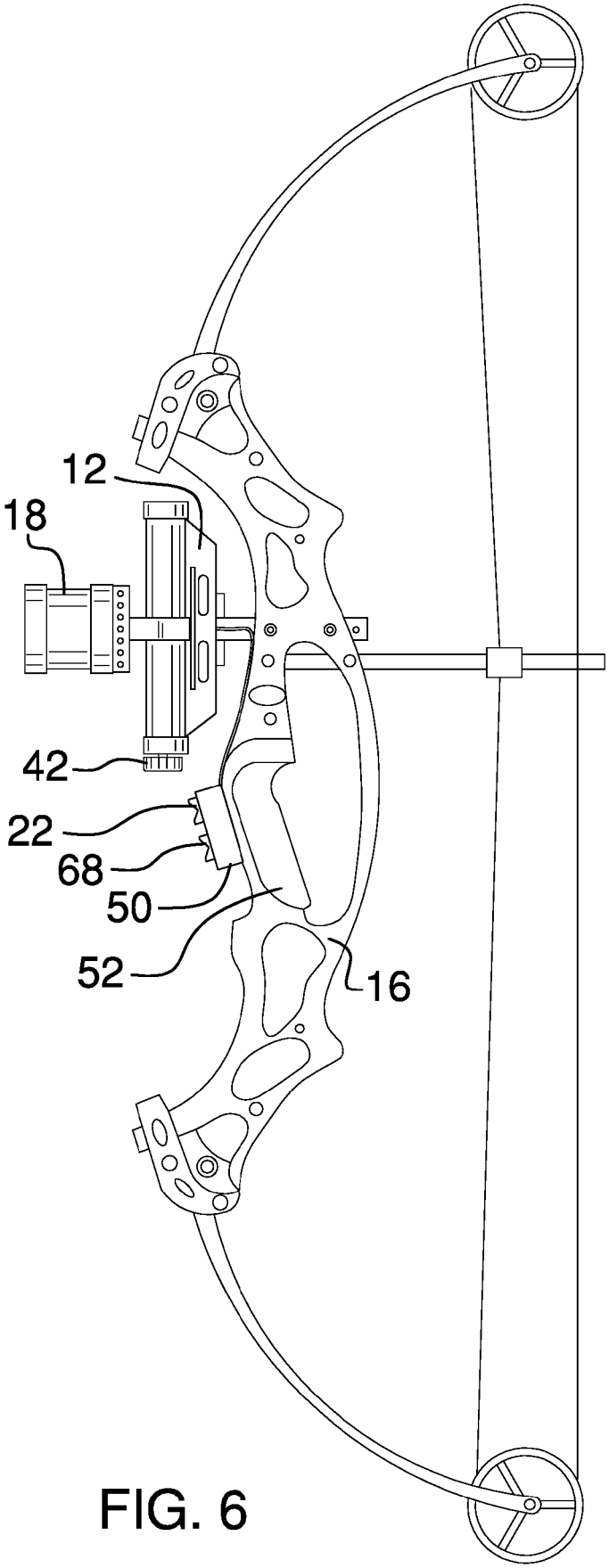
FIG. 6 is a side view of an embodiment of the disclosure in use.
Figure 7:
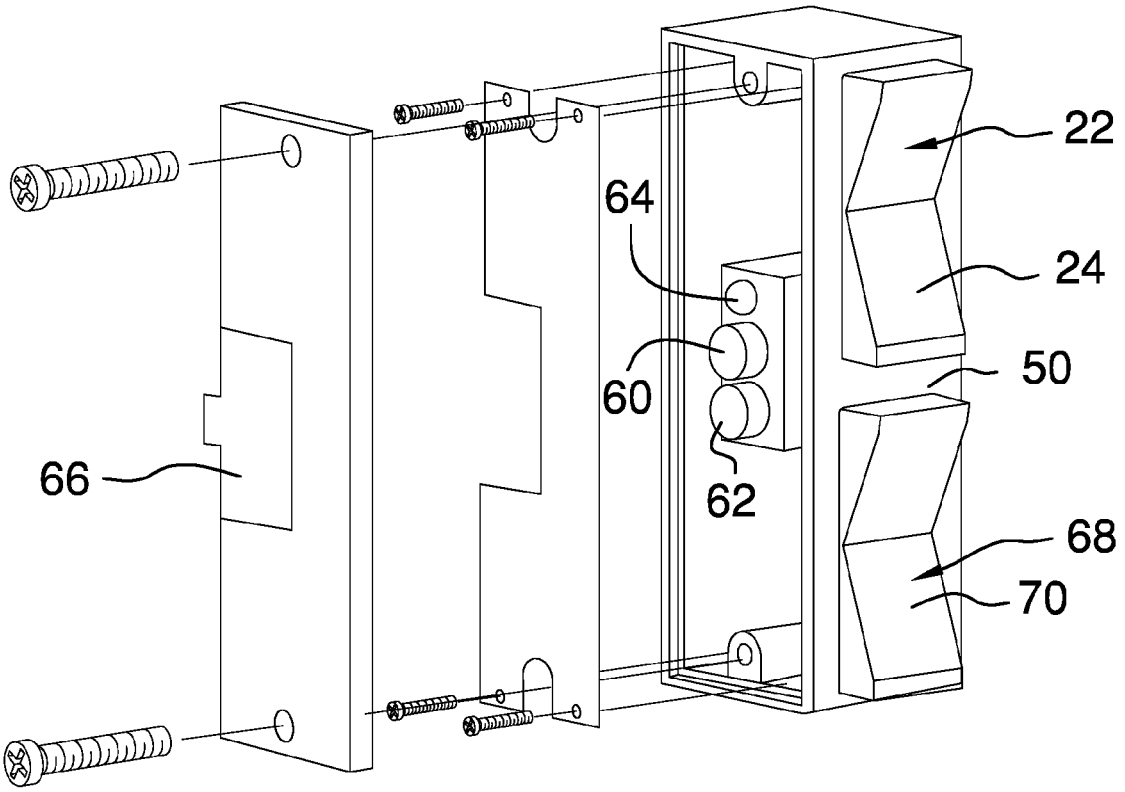
FIG. 7 is a partially exploded top front side perspective of a remote housing of an embodiment of the invention.
Figure 8:
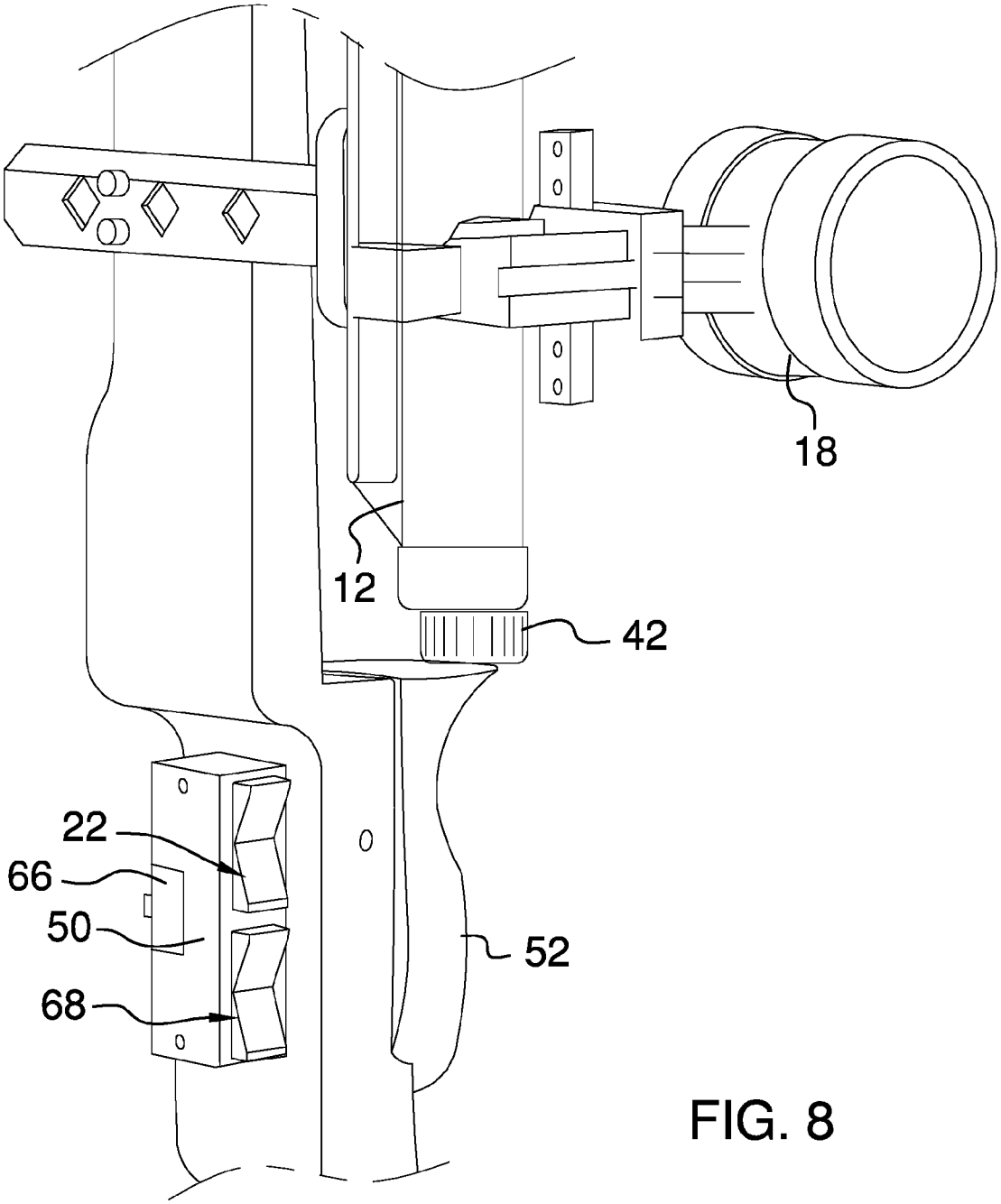
FIG. 8 is a top front side perspective partial view of an embodiment of the disclosure in use.

With reference now to the drawings, and in particular to FIGS. 1 through 8 thereof, a new archery sighting device embodying the principles and concepts of an embodiment of the disclosure and generally designated by the reference numeral 10 will be described.

As best illustrated in FIGS. 1 through 8, the programmable adjustment archery sighting device 10 generally comprises an elongated mounting bracket 12. Each of a pair of spaced mounting apertures 14 extends into the mounting bracket 12 wherein the mounting bracket 12 is configured for being coupled to an archery bow 16 in a fixed position relative to the archery bow 16. A sight 18 is coupled to the mounting bracket 12. The sight may be a conventional sighting tube or other conventional sight structure. A position of the sight 18 relative to the mounting bracket 12 is adjustable.

A vertical adjustment motor 40 is coupled to the mounting bracket 12. A vertical adjustment mechanism 20 is coupled to the mounting bracket 12 and the sight 18. The vertical adjustment motor 40 is operationally coupled to the vertical adjustment mechanism 20 such that the vertical adjustment mechanism 20 is actuated by activation of the vertical adjustment motor 40. The vertical adjustment mechanism 20 adjusts a position of the sight 18 along a longitudinal axis of the mounting bracket 12. The vertical adjustment mechanism 20 includes a first vertical adjustment control 22. The first vertical adjustment control 22 may be a rocker switch 24 wherein alternative pressing of opposite ends 26,28 of the first vertical adjustment control 22 alternatively moves the sight 18 up and down relative to the mounting bracket 12. The vertical adjustment mechanism 20 further includes a channel 30 extending through the mounting bracket 12 parallel to the spaced mounting apertures 14. Each of a pair of bearings 32 is positioned at an associated end 34 of the channel 30. A vertical adjustment screw 36 extends through the channel 30. The vertical adjustment motor 40 is mechanically coupled to the vertical adjustment screw 36 such that actuation of the vertical adjustment motor 40 rotates the vertical adjustment screw 36. Alternatively, the vertical adjustment screw 36 may be rotated by a manual vertical adjustment knob 42 coupled to the vertical adjustment screw 36. A slot 44 extends through the mounting bracket 12 on a forward face 46. A collar 48 is threadedly coupled to the vertical adjustment screw 36. The collar 48 extends outwardly from the mounting bracket 12 through the slot 44. A position of the collar 48 within the slot 44 is adjustable by rotation of the vertical adjustment screw 36. The sight 18 is coupled to the collar 48 whereby the vertical position of the sight 18 relative to the mounting bracket 12 is adjustable by rotation of the vertical adjustment screw 36.

A housing 50 is provided. The housing 50 is separate from the mounting bracket 12 wherein the housing 50 is configured for being positioned on the bow 16 spaced from the mounting bracket 12 and accessible to fingers on a hand grasping a grip 52 of the bow 16. The first vertical adjustment control 22 is positioned on the housing 50. The first vertical adjustment control 22 is operationally coupled to the vertical adjustment motor 40 wherein a vertical position of the sight 18 relative to the mounting bracket 12 is adjustable by manipulation of the first vertical adjustment control 22. A processor 54 is operationally coupled to the vertical adjustment motor 40. The processor 54 may be positioned in the mounting bracket 12 proximate the vertical adjustment motor 40. A position detector 56 is coupled to the processor 54 to determine a vertical position of the sight 18 relative to the mounting bracket 12. The position detector 56 may be a linear potentiometer 58 coupled to the vertical adjustment mechanism 20. The linear potentiometer 58 tracks a position of the collar 48 along the vertical adjustment screw 36. The linear potentiometer 58 is communicatively coupled to the processor 54 wherein the collar 48 is automatically movable to a set position along the vertical adjustment screw 36 programmed into the processor 54. The set position may be one of a series of set positions programmed into the processor 54.

A set button 60 is operationally coupled to the processor 54 wherein each set position is programmable by manipulation of the set button 60. A programming button 62 is operationally coupled to the processor 54 to define a programming mode and a non-programming mode. The set button 60 is usable to program each set position only during the programming mode. An indicator 64 is operationally coupled to the processor 54 wherein the indicator 64 provides a signal confirming programming of each set position. The set button 60, programming button 62, and indicator 64 may all be positioned within the housing 50. A door 66 may be provided to selectively cover and provide access to the set button 60, programming button 62, and indicator 64. To program the set positions the door 66 is opened. The programming button 62 is pressed to begin the programming mode. The sight 18 is then positioned at each position desired to be programmed. While in each position, the set button 60 is pressed and held until the indicator 64 provides the signal. The indicator 64 may be a light emitting diode which illuminates to provide the signal. The signal may be one or more illuminations of the light emitting diode to indicate the position of the newly programmed set position. When all set positions are programmed, the programming button 62 is pressed again to exit the programming mode and prevent accidental programming of unintended set positions. The door 66 may also be closed to restrict access to the set button 60 and the programming button 62, and to cover the indicator 64 to prevent distractions while using the bow 16.

A second vertical adjustment control 68 is positioned on the housing 50. The second vertical adjustment control 68 is operationally coupled to the processor 54 such that the sight 18 is movable between the plurality of programmed set positions by manipulation of the second vertical adjustment control 68. The second vertical adjustment control 68 may be a rocker switch 70 moving the sight 18 up or down to the next adjacent set position when the rocker switch 70 is manipulated.

A horizontal adjustment mechanism 72 is coupled to the mounting bracket 12 and the sight 18. More specifically, the horizontal adjustment mechanism 72 may be coupled to the mounting bracket 12 by being coupled to the collar 48. The horizontal adjustment mechanism 72 adjusts the position of the sight 18 perpendicular to the longitudinal axis of the mounting bracket 12. A horizontal adjustment motor 74 is coupled to the mounting bracket 12. The horizontal adjustment motor 74 is operationally coupled to the horizontal adjustment mechanism 72 such that the horizontal adjustment mechanism 72 is actuated by activation of the horizontal adjustment motor 74. The horizontal adjustment mechanism 72 includes a plate 76 coupled to and extending forwardly from the collar 48. A horizontal adjustment screw 78 extends through a threaded aperture 80 in the plate 76. The plate 76 may be attached to the collar 48 using engagement of pins 82 to selectable vertically aligned holes 84 for additional gross vertical adjustment of the sight 18 relative to the collar. The horizontal adjustment motor 74 is coupled to and rotates the horizontal adjustment screw 78. A slide 86 is coupled to the horizontal adjustment motor 74. The slide 86 is slidably inserted through and extends through the plate 76. The sight 18 is positioned at a distal end of the slide 86 relative to the horizontal adjustment motor 74. Thus, rotation of the horizontal adjustment screw 78 moves the horizontal adjustment screw 78, the horizontal adjustment motor 74, the slide 86, and the sight 18 relative to the plate 76 which is in a fixed position relative to the mounting bracket 12. The horizontal adjustment mechanism 72 includes a left button 88 and a right button 90. Each of the left button 88 and the right button 90 is operationally coupled to the horizontal adjustment motor 74 to rotate the horizontal adjustment screw 78 in opposite directions from each other such that a horizontal position of the sight 18 relative to the mounting bracket 12 is adjustable by manipulation of the left button 88 and the right button 90. A manual horizontal adjustment knob 92 is coupled to a distal end 94 of the horizontal adjustment screw 78 relative to the horizontal adjustment motor 74. A manual locking screw 96 may be inserted into the plate 76 to frictionally engage and prevent movement of the slide 86 through the plate 76.

In use, the horizontal adjustment mechanism 72 is utilized to position the sight 18 as desired perpendicular to the longitudinal axis of the mounting bracket 12. As fixedly attached to the bow 16 this adjustment would be consistent with what is known as windage adjustment. The programming button 64 and set button 62 are accessed. While in programming mode, the vertical adjustment mechanism is utilized to sequentially position the sight for programming the set positions as described above. After programming is complete, the bow 16 is used in a conventional manner while manipulation of the first vertical adjustment control 22 allows for additional adjustment of the sight 18 vertically. The finger accessible positioning and control allows for adjustment while the bow 16 is drawn. The second vertical adjustment control 68 is used to move through the programmed set positions for the sight 18 to facilitate gross adjustment of the sight 18 to accommodate changes in target distance.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An archery sighting device comprising:

a mounting bracket, said mounting bracket being elongated;

a pair of spaced mounting apertures extending into said mounting bracket wherein said mounting bracket is configured for being coupled to an archery bow in a fixed position relative to the archery bow;

a sight coupled to said mounting bracket, a position of said sight relative to said mounting bracket being adjustable;

a vertical adjustment mechanism coupled to said mounting bracket and said sight, said vertical adjustment mechanism adjusting a position of said sight along a longitudinal axis of said mounting bracket, said vertical adjustment mechanism including a first vertical adjustment control;

a vertical adjustment motor coupled to said mounting bracket, said vertical adjustment motor being operationally coupled to said vertical adjustment mechanism such that said vertical adjustment mechanism is actuated by activation of said vertical adjustment motor; and a housing, said housing being separate from said mounting bracket wherein said housing is configured for being positioned on a bow spaced from said mounting bracket and accessible to fingers on a hand grasping a grip of the bow, said first vertical adjustment control being positioned on said housing, said first vertical adjustment control being operationally coupled to said vertical adjustment motor wherein a vertical position of said sight relative to said mounting bracket is adjustable by manipulation of said first vertical adjustment control; and a manual vertical adjustment knob coupled to said vertical adjustment screw.

2. The device of claim 1, further comprising:

a processor, said processor being operationally coupled to said vertical adjustment motor; and a position detector coupled to said processor to determine a vertical position of said sight relative to said mounting bracket.

3. The device of claim 2, further comprising a set button operationally coupled to said processor wherein said set position is programmable by manipulation of said set button.

4. The device of claim 3, further comprising a programming button coupled to said processor, said programming button being operationally coupled to said processor to define a programming mode and a non-programming mode, said set button being usable to program said set position only during said programming mode.

5. The device of claim 3, further comprising an indicator operationally coupled to said processor wherein said indicator provides a signal confirming programming of said set position.

6. The device of claim 1, wherein said vertical adjustment mechanism comprises:

a channel extending through said mounting bracket parallel to said spaced mounting apertures;

a pair of bearings, each of said bearing being positioned at an associated end of said channel;

a vertical adjustment screw extending through said channel, said vertical adjustment motor being mechanically coupled to said vertical adjustment screw such that actuation of said motor rotates said vertical adjustment screw;

a slot extending through said mounting bracket; and a collar threadedly coupled to said vertical adjustment screw, said collar extending outwardly from said mounting bracket through said slot, a position of said collar within said slot being adjustable by rotation of said vertical adjustment screw, said sight being coupled to said collar.

7. The device of claim 1, further comprising:

a horizontal adjustment mechanism coupled to said mounting bracket and said sight, said horizontal adjustment mechanism adjusting the position of said sight perpendicular to said longitudinal axis of said mounting bracket; and a horizontal adjustment motor coupled to said mounting bracket, said horizontal adjustment motor being operationally coupled to said horizontal adjustment mechanism such that said horizontal adjustment mechanism is actuated by activation of said horizontal adjustment motor.

8. The device of claim 7, wherein said horizontal adjustment mechanism comprises a left button and a right button, each of said left button and said right button being operationally coupled to said horizontal adjustment motor such that a horizontal position of said sight relative to said mounting bracket is adjustable by manipulation of said left button and said right button.

9. An archery sighting device comprising:

a mounting bracket, said mounting bracket being elongated;

a pair of spaced mounting apertures extending into said mounting bracket wherein said mounting bracket is configured for being coupled to an archery bow in a fixed position relative to the archery bow;

a sight coupled to said mounting bracket, a position of said sight relative to said mounting bracket being adjustable;

a vertical adjustment mechanism coupled to said mounting bracket and said sight, said vertical adjustment mechanism adjusting a position of said sight along a longitudinal axis of said mounting bracket, said vertical adjustment mechanism including a first vertical adjustment control;

a vertical adjustment motor coupled to said mounting bracket, said vertical adjustment motor being operationally coupled to said vertical adjustment mechanism such that said vertical adjustment mechanism is actuated by activation of said vertical adjustment motor;

a housing, said housing being separate from said mounting bracket wherein said housing is configured for being positioned on a bow spaced from said mounting bracket and accessible to fingers on a hand grasping a grip of the bow, said first vertical adjustment control being positioned on said housing, said first vertical adjustment control being operationally coupled to said vertical adjustment motor wherein a vertical position of said sight relative to said mounting bracket is adjustable by manipulation of said first vertical adjustment control;

a processor, said processor being operationally coupled to said vertical adjustment motor; and a position detector coupled to said processor to determine a vertical position of said sight relative to said mounting bracket, said position detector being a linear potentiometer coupled to said vertical adjustment mechanism, said linear potentiometer tracking a position of said collar along said vertical adjustment screw, said linear potentiometer being communicatively coupled to said processor wherein said collar is automatically movable to a set position along said vertical adjustment screw programmed into said processor.

10. The device of claim 1, wherein said first vertical adjustment control comprises a rocker switch wherein pressing of opposite ends of said first vertical adjustment control alternatively moves said sight up and down relative to said mounting bracket.

11. An archery sighting device comprising:

a mounting bracket, said mounting bracket being elongated;

a pair of spaced mounting apertures extending into said mounting bracket wherein said mounting bracket is configured for being coupled to an archery bow in a fixed position relative to the archery bow;

a sight coupled to said mounting bracket, a position of said sight relative to said mounting bracket being adjustable;

a vertical adjustment mechanism coupled to said mounting bracket and said sight, said vertical adjustment mechanism adjusting a position of said sight along a longitudinal axis of said mounting bracket, said vertical adjustment mechanism including a first vertical adjustment control;

a vertical adjustment motor coupled to said mounting bracket, said vertical adjustment motor being operationally coupled to said vertical adjustment mechanism such that said vertical adjustment mechanism is actuated by activation of said vertical adjustment motor;

a housing, said housing being separate from said mounting bracket wherein said housing is configured for being positioned on a bow spaced from said mounting bracket and accessible to fingers on a hand grasping a grip of the bow, said first vertical adjustment control being positioned on said housing, said first vertical adjustment control being operationally coupled to said vertical adjustment motor wherein a vertical position of said sight relative to said mounting bracket is adjustable by manipulation of said first vertical adjustment control;

a processor, said processor being operationally coupled to said vertical adjustment motor;

a position detector coupled to said processor to determine a vertical position of said sight relative to said mounting bracket; and a second vertical adjustment control, said second vertical adjustment control being positioned on said housing, said second vertical adjustment control being operationally coupled to said processor such that said sight is movable between a plurality of programmed set positions by manipulation of said second vertical adjustment control.

12. An archery sighting device comprising:

a mounting bracket, said mounting bracket being elongated;

a pair of spaced mounting apertures extending into said mounting bracket wherein said mounting bracket is configured for being coupled to an archery bow in a fixed position relative to the archery bow;

a sight coupled to said mounting bracket, a position of said sight relative to said mounting bracket being adjustable;

a vertical adjustment mechanism coupled to said mounting bracket and said sight, said vertical adjustment mechanism adjusting a position of said sight along a longitudinal axis of said mounting bracket, said vertical adjustment mechanism including a first vertical adjustment control;

a vertical adjustment motor coupled to said mounting bracket, said vertical adjustment motor being operationally coupled to said vertical adjustment mechanism such that said vertical adjustment mechanism is actuated by activation of said vertical adjustment motor;

a housing, said housing being separate from said mounting bracket wherein said housing is configured for being positioned on a bow spaced from said mounting bracket and accessible to fingers on a hand grasping a grip of the bow, said first vertical adjustment control being positioned on said housing, said first vertical adjustment control being operationally coupled to said vertical adjustment motor wherein a vertical position of said sight relative to said mounting bracket is adjustable by manipulation of said first vertical adjustment control;

a horizontal adjustment mechanism coupled to said mounting bracket and said sight, said horizontal adjustment mechanism adjusting the position of said sight perpendicular to said longitudinal axis of said mounting bracket; and a horizontal adjustment motor coupled to said mounting bracket, said horizontal adjustment motor being operationally coupled to said horizontal adjustment mechanism such that said horizontal adjustment mechanism is actuated by activation of said horizontal adjustment motor; and a manual horizontal adjustment knob coupled to said horizontal adjustment screw.

13. An archery sighting device comprising:

a mounting bracket, said mounting bracket being elongated;

a pair of spaced mounting apertures extending into said mounting bracket wherein said mounting bracket is configured for being coupled to an archery bow in a fixed position relative to the archery bow;

a sight coupled to said mounting bracket, a position of said sight relative to said mounting bracket being adjustable;

a vertical adjustment motor coupled to said mounting bracket;

a vertical adjustment mechanism coupled to said mounting bracket and said sight, said vertical adjustment motor being operationally coupled to said vertical adjustment mechanism such that said vertical adjustment mechanism is actuated by activation of said vertical adjustment motor, said vertical adjustment mechanism adjusting a position of said sight along a longitudinal axis of said mounting bracket, said vertical adjustment mechanism including a first vertical adjustment control, said first vertical adjustment control being a rocker switch wherein pressing of opposite ends of said first vertical adjustment control alternatively moves said sight up and down relative to said mounting bracket, said vertical adjustment mechanism comprising a channel extending through said mounting bracket parallel to said spaced mounting apertures, a pair of bearings, each of said bearings being positioned at an associated end of said channel, a vertical adjustment screw extending through said channel, said vertical adjustment motor being mechanically coupled to said vertical adjustment screw such that actuation of said motor rotates said vertical adjustment screw, a slot extending through said mounting bracket, and a collar threadedly coupled to said vertical adjustment screw, said collar extending outwardly from said mounting bracket through said slot, a position of said collar within said slot being adjustable by rotation of said vertical adjustment screw, said sight being coupled to said collar;

a housing, said housing being separate from said mounting bracket wherein said housing is configured for being positioned on a bow spaced from said mounting bracket and accessible to fingers on a hand grasping a grip of the bow, said first vertical adjustment control being positioned on said housing, said first vertical adjustment control being operationally coupled to said vertical adjustment motor wherein a vertical position of said sight relative to said mounting bracket is adjustable by manipulation of said first vertical adjustment control;

a processor, said processor being operationally coupled to said vertical adjustment motor;

a position detector coupled to said processor to determine a vertical position of said sight relative to said mounting bracket, said position detector is a linear potentiometer coupled to said vertical adjustment mechanism, said linear potentiometer tracking a position of said collar along said vertical adjustment screw, said linear potentiometer being communicatively coupled to said processor wherein said collar is automatically movable to a set position along said vertical adjustment screw programmed into said processor;

a set button operationally coupled to said processor wherein said set position is programmable by manipulation of said set button;

a programming button coupled to said processor, said programming button being operationally coupled to said processor to define a programming mode and a non-programming mode, said set button being usable to program said set position only during said programming mode;

an indicator operationally coupled to said processor wherein said indicator provides a signal confirming programming of said set position;

a second vertical adjustment control, said second vertical adjustment control being positioned on said housing, said second vertical adjustment control being operationally coupled to said processor such that said sight is movable between a plurality of programmed set positions by manipulation of said second vertical adjustment control;

a horizontal adjustment mechanism coupled to said mounting bracket and said sight, said horizontal adjustment mechanism adjusting the position of said sight perpendicular to said longitudinal axis of said mounting bracket;

a horizontal adjustment motor coupled to said mounting bracket, said horizontal adjustment motor being operationally coupled to said horizontal adjustment mechanism such that said horizontal adjustment mechanism is actuated by activation of said horizontal adjustment motor, said horizontal adjustment mechanism including a left button and a right button, each of said left button and said right button being operationally coupled to said horizontal adjustment motor such that a horizontal position of said sight relative to said mounting bracket is adjustable by manipulation of said left button and said right button;

a manual vertical adjustment knob coupled to said vertical adjustment screw; and a manual horizontal adjustment knob coupled to said horizontal adjustment screw.

* * * * *